US011364510B2

(12) United States Patent
Dane

(10) Patent No.: US 11,364,510 B2
(45) Date of Patent: Jun. 21, 2022

(54) MULTIPLE NOZZLE SYSTEM

(71) Applicant: Willis Dane, Peru, IL (US)

(72) Inventor: Willis Dane, Peru, IL (US)

( * ) Notice: Subject to any disclaimer, the term of this patent is extended or adjusted under 35 U.S.C. 154(b) by 261 days.

(21) Appl. No.: 16/688,038

(22) Filed: Nov. 19, 2019

(65) Prior Publication Data

US 2020/0156087 A1 May 21, 2020

Related U.S. Application Data

(60) Provisional application No. 62/769,904, filed on Nov. 20, 2018.

(51) Int. Cl.
*B05B 17/08* (2006.01)
*B05B 1/14* (2006.01)
*B05B 1/10* (2006.01)

(52) U.S. Cl.
CPC ..... *B05B 1/14* (2013.01); *B05B 1/10* (2013.01); *B05B 17/08* (2013.01)

(58) Field of Classification Search
CPC ... B05B 3/026; B05B 211/14; B05B 1017/08; B05B 17/08; B05B 1/14; B05B 3/06
See application file for complete search history.

(56) References Cited

U.S. PATENT DOCUMENTS 158,903 A * 1/1875 Buttles ..... B05B 3/06 239/262
2,970,771 A * 2/1961 Przystawik ..... B05B 17/08 239/536
2,979,272 A * 4/1961 Thorrez ..... B05B 3/06 239/602
5,074,471 A * 12/1991 Baumgarten ..... B60S 1/522 239/602
5,462,230 A * 10/1995 Van Ouwerkerk ... F24F 13/065 239/597
5,920,925 A * 7/1999 Dongo ..... A61H 33/6057 4/492
6,082,633 A * 7/2000 Kephart ..... B05B 15/625 239/536
6,178,570 B1 * 1/2001 Denst ..... A61H 33/6057 239/420
6,250,570 B1 * 6/2001 Starr ..... B05B 1/3478 239/472
6,848,637 B2 * 2/2005 Holtsnider ..... A61H 33/6063 239/492
7,043,775 B2 * 5/2006 Holtsnider ..... A61H 33/6057 239/249
8,151,885 B2 * 4/2012 Bull ..... E21B 43/04 166/305.1
9,352,340 B2 * 5/2016 Bourrilhon ..... A62C 31/05
9,630,192 B2 * 4/2017 Kusu ..... B05B 3/02
(Continued)

*Primary Examiner* — Joseph A Greenlund
(74) *Attorney, Agent, or Firm* — Knechtel, Demueur & Samlan

(57) ABSTRACT

A multiple nozzle system and device that provides flow control, a nozzle base, the inclusion of a flare or a reversible flare, or a twister attachment, along with various desired directional arm(s) formed from nozzles or the combination of nozzles and elbows, for creating any desired directional angle(s) for each of the directional arm(s). Based on this invention, the water (or angled streams) exiting from the combination of the various directional arm(s) creates an unlimited number of possible resulting fountains or other visual water displays, spray patterns, or designs.

17 Claims, 13 Drawing Sheets

(56) References Cited

U.S. PATENT DOCUMENTS

| | | | | |
|---|---|---|---|---|
| 2003/0168523 | A1* | 9/2003 | Lin | B05B 3/06 239/251 |
| 2010/0006670 | A1* | 1/2010 | Bourrilhon | B05B 7/0475 239/398 |
| 2011/0121099 | A1* | 5/2011 | Han | B05B 7/0425 239/263 |
| 2016/0199679 | A1* | 7/2016 | Kusu | A62C 31/05 239/243 |
| 2020/0023386 | A1* | 1/2020 | Sturdy | B05B 1/14 |
| 2020/0156087 | A1* | 5/2020 | Dane | B05B 17/08 |
| 2020/0254466 | A1* | 8/2020 | Dane | B05B 3/021 |
| 2020/0360961 | A1* | 11/2020 | Tanaka | B05B 17/08 |

* cited by examiner

MULTIPLE NOZZLE SYSTEM

I. CROSS-REFERENCE TO RELATED APPLICATION

This patent application is a non-provisional application claiming priority from U.S. Provisional Patent Application Ser. No. 62/769,904, entitled Multiple Nozzle System, filed on Nov. 20, 2018, and is fully incorporated herein by reference.

II. FIELD OF THE INVENTION

The present invention relates to a multiple nozzle system that is molded as multiple parts and used by assembling in various combinations with various components. The multiple nozzle system, in a non-limiting example, comprises nozzles, flow controls, nozzle base, flare, and various elbows that are arranged in a generally vertical orientation with each tilting slightly outwardly from the centerline, and with nozzles and flow controls attached to create a wide variety of possible spray patterns.

III. DESCRIPTION OF THE PRIOR ART

Currently, there are several devices in the market that are designed to create multiple patterns. These devices are simplistic in that the user drills multiple holes in the device to create the nozzles and then plugs or blocks certain holes for the desired pattern. As a result, these types of devices are limited to just a few patterns. Also, the additional problems with this approach is that (a) it is very difficult to create good quality streams with this crude approach, and (b) the limitation in number of possible patterns automatically excludes all other patterns and thwarts further creative designs. Applicant's invention, however, solves these problems.

Thus, there is a need, therefore, and there has never been disclosed Applicant's invention.

IV. SUMMARY OF THE INVENTION

The present invention is a multiple nozzle system and device that provides flow control, a nozzle base, the inclusion of a flare or a reversible flare, or a twister attachment, along with various desired directional arm(s) formed from nozzles or the combination of nozzles and elbows, for creating any desired directional angle(s) for each of the directional arm(s). Based on this invention, the water (or angled streams) exiting from the combination of the various directional arm(s) creates an unlimited number of possible resulting fountains or other visual water displays, spray patterns, or designs.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Applicant's multiple nozzle system is used in fountain or aeration devices for creating attractive water displays in a pond or lake. In use, water comes up from the bottom through Applicant's multiple nozzle system and the various nozzle designs and out the top. Depending upon the flow control, flare, elbow extensions and angles created, and nozzle tips and length, the water exits from the various nozzles, which in combination, creates a resulting fountain or other visual water displays, spray patterns, or designs.

Figure 2:
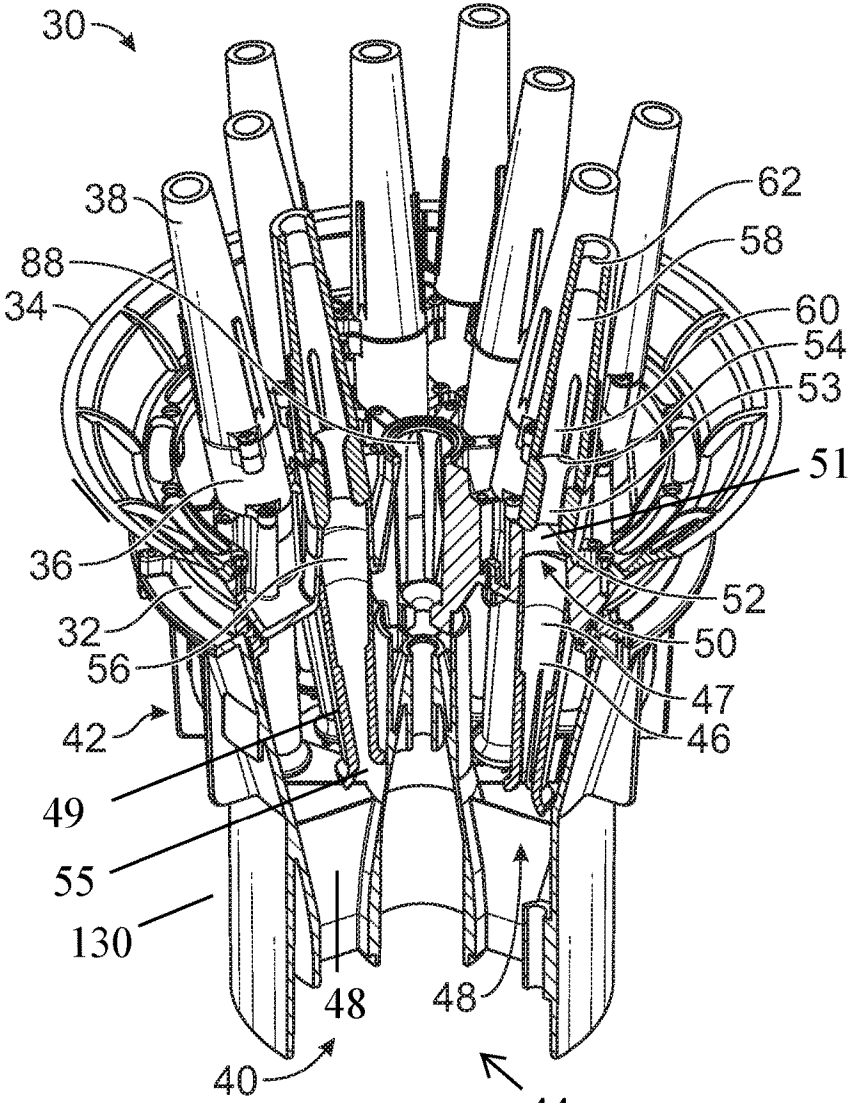
FIG. 2 is a cutaway top perspective view, with portions removed, of the multiple nozzle system device as illustrated in FIG. 1.
Figure 1:
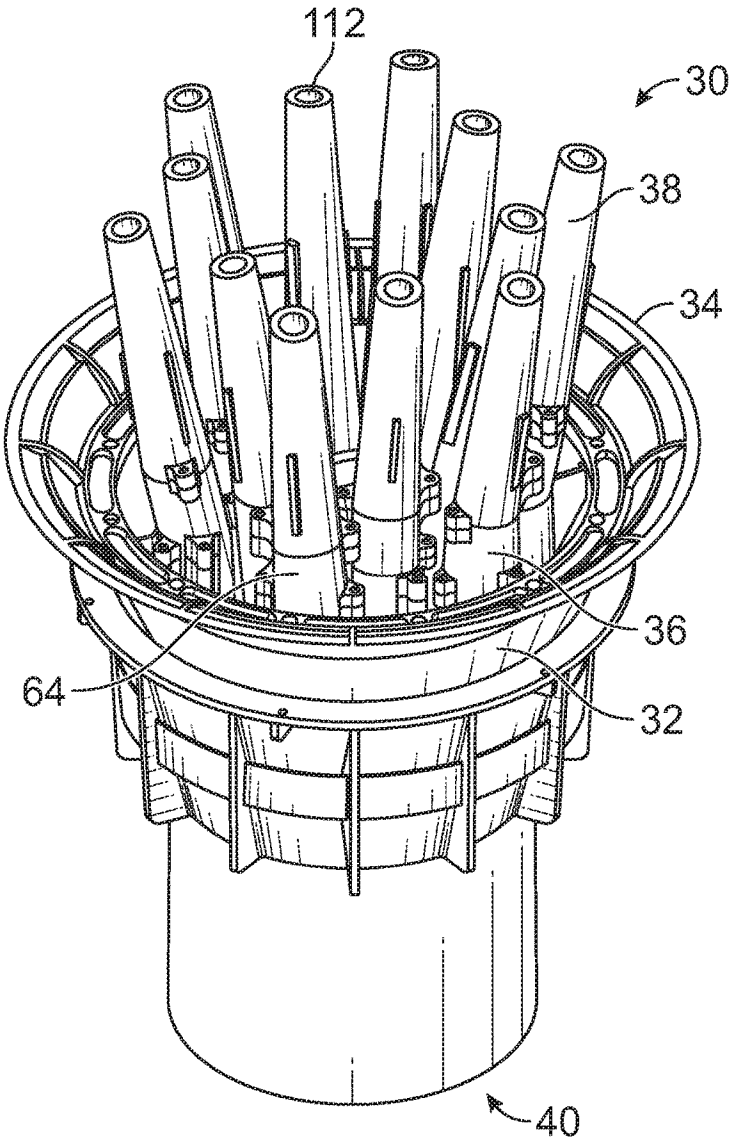
FIG. 1 is a top perspective view of Applicant's multiple nozzle system device.
Figure 3:
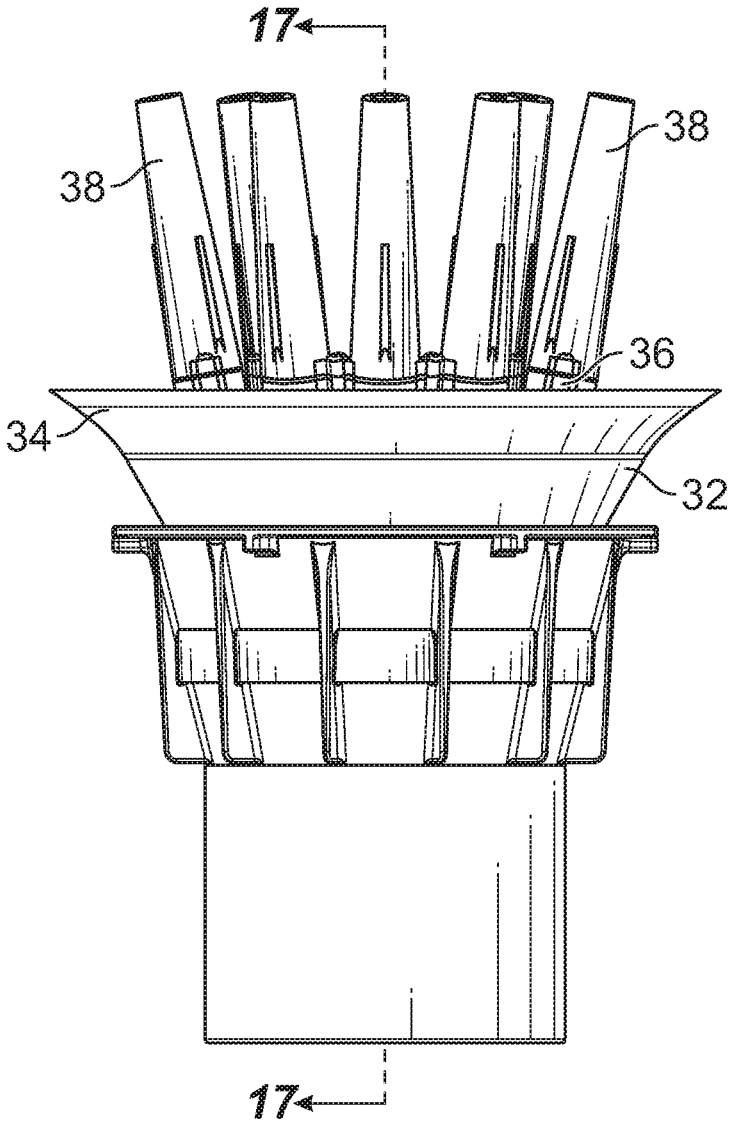
FIG. 3 is a side perspective view of the multiple nozzle system device and, in particular, illustrating the nozzle base, flare, elbows, and nozzles.

As a result and to accomplish this, as illustrated in FIGS. 1 and 2, Applicant's multiple nozzle system and device 30, provides many new and inventive elements including, without limitation, a nozzle base 32, a flare 34, elbows 36, nozzles 38, and twister attachment 108.

The device 30 is a hollow body 44 designed, at one end, with an inlet 40 and, at the other end, with an outlet 42. In the preferred embodiment, the outflow transition 130 takes the water from the pump into the inlet 40 and out the outlet 42 and to the nozzle base 32 where flow controls, if used, elbows 36, if used and nozzles 38 are attached to collectively control and/or create, using the resulting stream, any desired resulting visual water display, fountain, spray pattern, and/or design through the device 30. In the preferred embodiment, the visual water display, fountain, spray pattern, and/or design are comprised of water. Alternatively, the visual water display, fountain, spray pattern, and/or design may be comprised of any other substance as known to those skilled in the art.

Also, situated and extending within the hollow body 44 of the device 30 are channels 46. Each channel 46 has a channel hollow center 47, a channel inlet 48, and a channel outlet 50. The channels 46 are releasably attached to the nozzle base 32.

Situated within one or more of the channels 46 is a flow control 49. The flow control 49 restricts the flow of water to the nozzle 38 (described below) so that the water stream exiting the nozzle 38 cannot go as high from that nozzle 38 as it would from the nozzle 38 without the flow control 49. The resulting lower height allows a spray pattern to be created with different height streams from the same water pressure of nozzles 38 without the flow control 49.

The flow control 49 has an inlet opening 55 that is smaller than the nozzle outlet 62 (described below) with the flow control 49, at this inlet opening 55, being rounded so that the water flows smoothly into and thru the inlet opening 55 and insures that the flow control 49 does not create any turbulence in this inlet opening 55. The diameter of the water flow through the flow control 55 is then gradually increased (i.e. as the flow control 55 is gradually tapered outwardly) until it matches the nozzle inlet 60 (described below), which also prevents turbulence in the water entering the nozzle 38 so that the nozzle 38 can create a smooth and turbulence free stream. The flow control 49 can only pass the volume of water that is possible based on the pressure and the size of the inlet opening 55. So, the flow control 55 restricts the flow of water to the nozzle 38 and thereby reduces the water pressure at the inlet to the nozzle 38 so that the water cannot spray as high.

The elbow 36 likewise has an elbow hollow center 53, an elbow inlet 52, and an elbow outlet 54. In the preferred embodiment, the elbow inlet 52 of the elbow 36 is releasably attached to the nozzle base 32 with the elbow hollow center 53, through a nozzle base channel 51, is in alignment with the channel outlet 50 of the channel 46. In this manner, when connected, the elbow hollow center 53 of the elbow 36 and the channel hollow center 47 form, through the nozzle base channel 51 in the nozzle base 32, a single hollow passageway 56.

The nozzle 38 also has a nozzle hollow center 58, a nozzle inlet 60, and a nozzle outlet 62. In the preferred embodiment, the nozzle inlet 60 of the nozzle 38 is releasably attached to the elbow outlet 54 of the elbow 36. In this manner, when connected, the nozzle hollow center 58 of the nozzle 38 and the elbow hollow center 53 and the channel hollow center 47 collectively then form the single hollow passageway 56. Alternatively, the nozzle inlet 60 of the nozzle 38 could be releasably attached directly to the channel outlet 50 of the channel 46 (i.e., eliminating the elbow 36, if desired). In this manner, when connected, the nozzle hollow center 58 of the nozzle 38 and the channel hollow center 47 would then collectively form the single hollow passageway 56.

In a non-limiting example, the device 30 is shown having twelve (12) nozzles 38. Alternatively, the number or plurality of nozzles 38 may be more or less, as desired, provided that the number of nozzles 38 used accomplishes the invention as described herein. In this manner, each of the nozzles 38 could be releasably attached or connected to a corresponding elbow 36 or the nozzle base 32, with each of the nozzles 38 in alignment, through the nozzle base channel 51 in the nozzle base 32, with a corresponding channel 46, and then, for each elbow 36 used, the elbow 36 could then be releasably attached or connected to the nozzle base 32, with each elbow 36 in alignment, through the nozzle base channel 51 in the nozzle base 32, with a corresponding channel 46. Each individual combination of the nozzle 38, the elbow 36, and the channel 46, or combination of the nozzle 38 and the corresponding channel 46, collectively forms a directional arm 64. If, using the non-limiting example as illustrated in FIGS. 1 and 2, these individual combination(s) would then form a total of twelve (12) directional arms 64.

Also, to accomplish this mating and interaction of parts, the nozzle base 32, the channel 46, the elbows 36, and the nozzles 38 all have the same mating parts so they can be easily connected, interchanged, as needed or desired.

Turning to FIGS. 8 through 16, the various interconnections of the nozzles 38 to the elbows 36 and combination of resulting angles of the directional arms 64 are more clearly illustrated.

Figure 8:
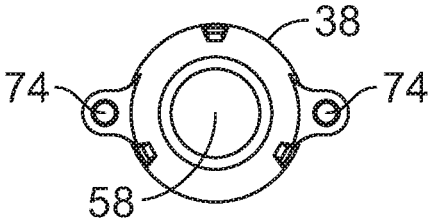
FIG. 8 is a top view of the nozzle and, in particular, illustrating the nozzle hollow center.
Figure 9:
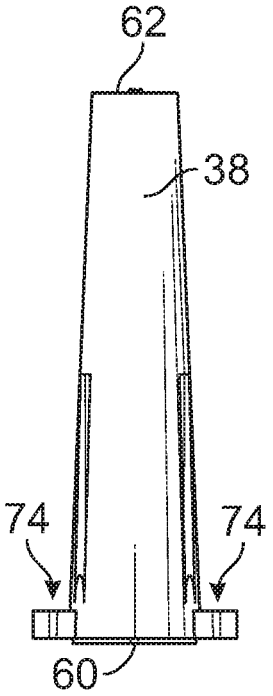
FIG. 9 is a front perspective view of the nozzle and, in particular, illustrating the tapering of the nozzle from the nozzle inlet to the nozzle outlet.

As illustrated in FIGS. 8 and 9, the nozzle 38 preferably tapers inwardly from the nozzle inlet 60 to the nozzle outlet 62. In a non-limiting example, the diameter of the nozzle hollow center 58 at the nozzle outlet 62 may be, for example, 0.5 inches or 0.6 inches. Alternatively, the diameter of the nozzle hollow center 58 may be larger or smaller as desired, provided that the nozzle hollow center 58 accomplishes the invention as described herein.

Figure 10:
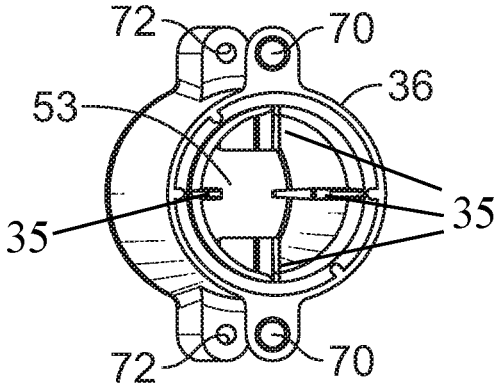
FIG. 10 is a top perspective view of the elbow and, in particular, illustrating the elbow hollow center providing anti-turbulent vanes and elbow angle of the elbow as shown in FIG. 11.
Figure 11:
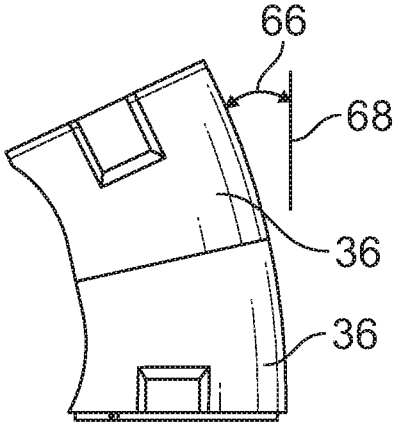
FIG. 11 is a side perspective view of the elbow and, in particular, illustrating a first example of an elbow angle (e.g., a twenty-five degree elbow angle).
Figure 12:
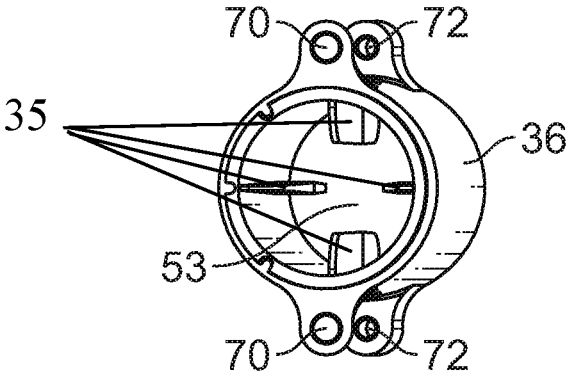
FIG. 12 is a top perspective view of the elbow and, in particular, illustrating the elbow hollow center providing anti-turbulent vanes and elbow angle of the elbow as shown in FIG. 13.
Figure 13:
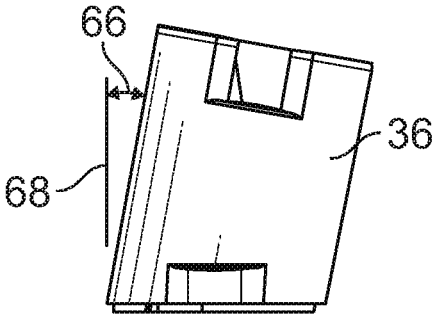
FIG. 13 is a side perspective view of the elbow and, in particular, illustrating a second example of an elbow angle (e.g., a ten degree elbow angle).

The elbow 36 is designed to accommodate an angle 66, as measured from a vertical plane 68. In the non-limiting example, as illustrated in FIGS. 10 and 11, the angle 66 of the elbow 36 is substantially at twenty-five degrees 25°; as illustrated in FIGS. 12 and 13, the angle 66 of the elbow 36 is substantially at ten degrees (10°). Also, each elbow 36 is provided with a plurality of anti-turbulent vanes 35 to streamline the water forced through the elbows 36 and each directional arm 64 (discussed in more detail below).

Figure 16:
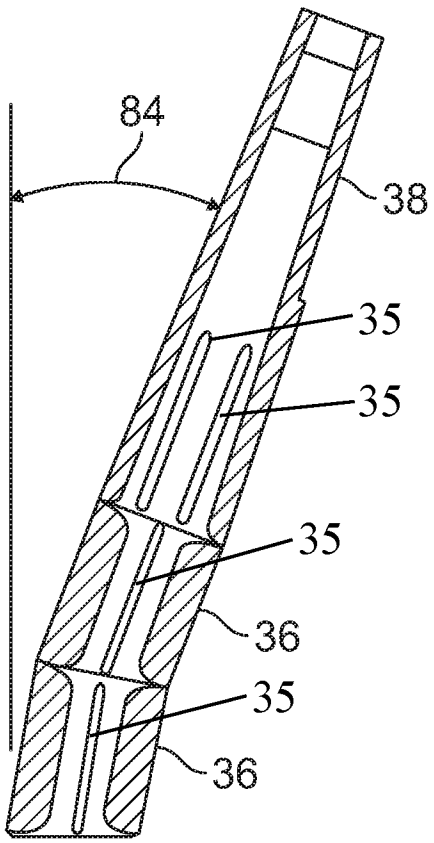
FIG. 16 is a right side cross-sectional view, taken along line 16-16 of FIG. 15, of the nozzle as releasably attaching or mating to stackable elbows and, in particular, illustrating the resulting directional arm at the directional angle.
Figure 15:
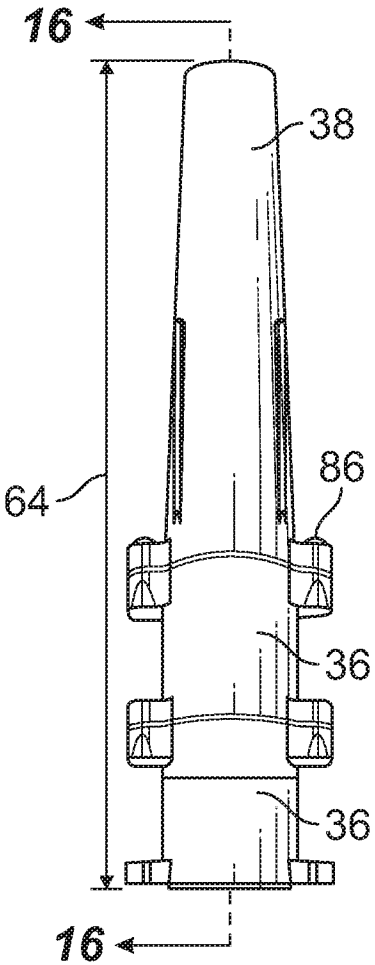
FIG. 15 is a front side perspective view of the nozzle as releasably attaching or mating to stackable elbows as illustrated in FIG. 14 and, in particular, illustrating the resulting directional arm at the directional angle.
Figure 14:
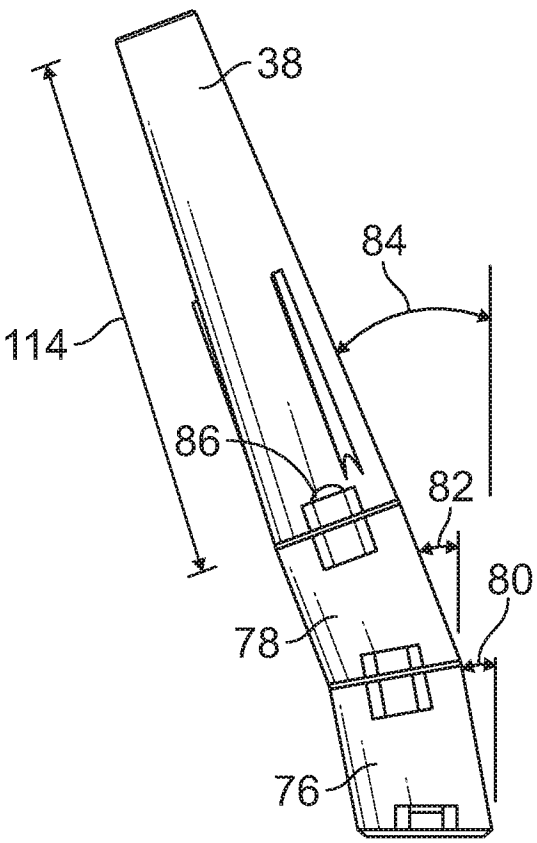
FIG. 14 is a left side perspective view of the nozzle as releasably attaching or mating to stackable elbows and as also shown in FIGS. 15 and 16.

The elbow 36 is also provided with upper opposed holes 70 and lower opposed holes 72 (see FIGS. 10 and 12) and the nozzle 38 is likewise provided with opposed holes 74 (see FIG. 8). In the preferred embodiment, the releaseable attachment or mating of the nozzle 38 to the elbow 36 is accomplished by aligning the opposed holes 74 of the nozzle 38 with the upper opposed holes 70 of the elbow 36. In this manner, mechanical fasteners 86, such as threaded screws or bolts can be inserted through each of the opposed holes 74 and upper opposed holes 70 to secure the nozzle 38 to the elbow 36, as illustrated in FIGS. 14 through 16. Alternatively, any other means for securing the opposed holes 74 of the nozzle 38 to upper opposed holes 70 of the elbow 36 to releasably secure one another together.

Preferably, the elbow 36, by itself, or stacked in combination with another elbow 36, can create or form the desired angle of the directional arms 64. For example, and as illustrated in FIGS. 14 through 16, a first elbow 76 is illustrated as having a first angle 80. A second elbow 78, stacked on top of the first elbow 80, is illustrated as having a second angle 82. If, in a non-limiting example, the first angle 80 of the first elbow 76 is ten degrees (10°) and the second angle 82 of the second elbow 78 is likewise ten degrees (10°) and both of the first elbow 76 and the second elbow 78 are releasably attached or secured to the nozzle 38, this would result in a total directional angle 84 of the directional arm 64 to be twenty degrees (20°) (e.g., which is the combined total of both the first angle 80 and the second angle 82).

Alternatively, if the first angle 80 of the first elbow 76 is ten degrees (10°) and only this first elbow 76, individually, is releasably attached or secured to the nozzle 38, this would result in a total directional angle 84 of the directional arm 64 to be ten degrees)(10° (e.g., which is the total of just the first angle 80).

In another non-limiting alternative, if the first angle 80 of the first elbow 76 is twenty-five degrees (25°) (i.e., using the angle 66 of the elbow 36 as illustrated in FIGS. 10 and 11), only this first elbow 76, individually, is releasably attached or secured to the nozzle 38, this would result in a total directional angle 84 of the directional arm 64 to be twenty-five degrees (25°) (e.g., which again is the total of just the first angle 80 but using a first elbow 76 having a different first angle 80).

Likewise, the combination and angles of the elbows can be reversed to achieve an increase (i.e., albeit smaller increase), as desired. In another non-limiting alternative example, if the first angle 80 of the first elbow 76 is twenty-five degrees (25°) and the second angle 82 of the second elbow 78 is a reversed ten degrees (10°) (i.e., the second elbow 78 is releasably attached or secured to the first elbow 76 in a reversed orientation), this would result in the total directional angle 84 of the directional arm 64 to be fifteen degrees (15°) (e.g., which is the combined total of both the first angle 80 of twenty-five degrees (25°) minus the second angle 82 of ten degrees (10°) resulting in the total directional angle 84 of fifteen degrees (15°).

In this manner, multiple elbows can be stacked one on top of another to increase the directional angle 84 of the directional arm 64 to create or form streams emanating from the device 30 in a preferred range of substantially five degrees (5°) up to sixty degrees (60°) to the vertical in any of the desired nozzles 38. Alternatively, the range of the directional angle 84 may be higher or lower depending upon the spray pattern desired.

Additionally, based on the various combination(s), Applicant's device 30 allows any of the nozzles 38 and/or directional arms 64 to be designed to accommodate any angle in five degree (5°) increments such as (5°, 10°, 15°, 20°, 25°, etc.) where the five degree (5°) angle is created by using the combination of a first angle 80 of the first elbow 76 to be twenty-five degree (25°) and the second angle 82 of the second elbow 78 in a ten degree (10°) angle reversed orientation to the first elbow 76 along with a third angle of a third elbow in likewise another ten degree (10°) angle reversed orientation to the first elbow 76 (e.g., which is the combined total of the first angle 80 of twenty-five degrees (25°) minus the second angle 82 of ten degrees (10°) minus the third angle of ten degrees (10°) resulting in the total directional angle 84 of five degrees (5°).

Thus, in the present non-limiting example of twelve (12) nozzles 38, as illustrated in FIGS. 1 and 2, or any number of nozzles 38 desired by the user, each nozzle 38 could have none or one or more elbows 36 attached or stacked in combination with each nozzle 38 to create the same or any different directional angles 84, as desired by the user, for each of the twelve (12) nozzles, or any number of nozzles 38 desired by the user, and/or required or used in producing the desired fountain or other visual water displays, spray patterns, and/or designs.

And, the nozzle base 32 and all of the various elbow(s) 36 and/or nozzle(s) 38 are designed to accommodate high volumes of water to flow through these well engineered parts, thus, producing heavy, clean, and attractive streams—this is likewise another capability not achieved by other prior art devices.

Figure 17:
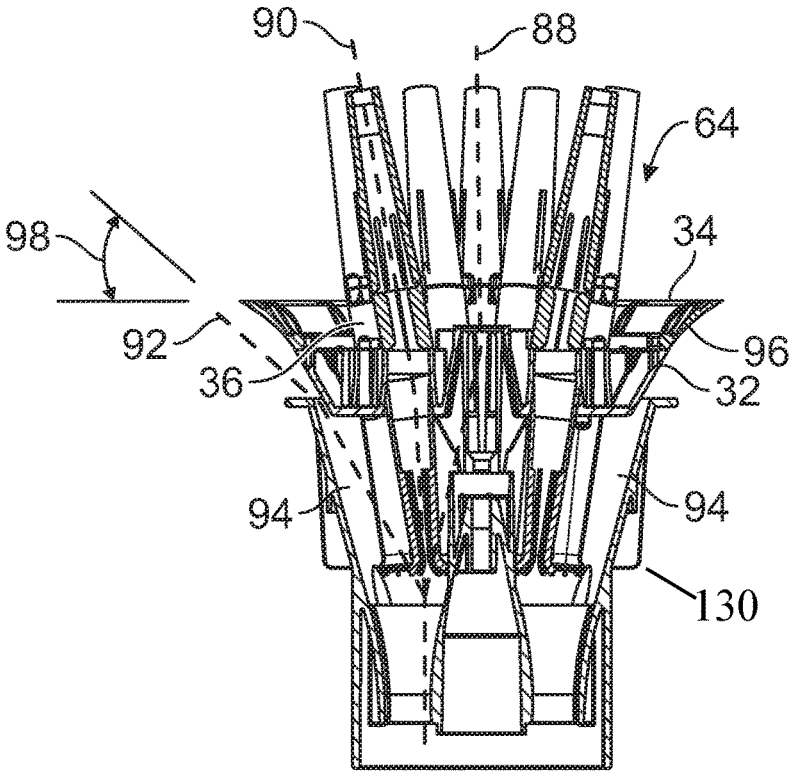
FIG. 17 is a front side cross-sectional view, taken along line 17-17 of FIG. 3, of the multiple nozzle system device and, in particular, illustrating each of the resulting directional angle(s) for each of the directional arm(s) and resulting flow or stream of water from the device.
Figure 18:
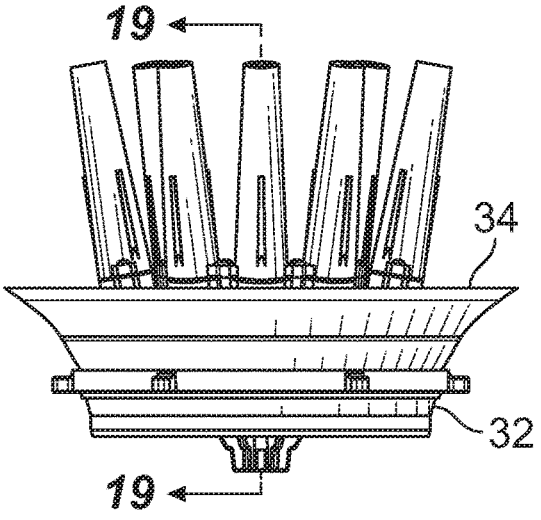
FIG. 18 is a front perspective view of the flare or flare attachment to the nozzle base.

Turning to FIG. 17, upon the creation of each directional arm 64 resulting from any combination or not of the elbow 36 or elbow(s) 36 and resulting directional angle(s) 84 for each of the directional arm(s) 64, the resulting flow or stream of water from the device 30 is more clearly illustrated. A center vertical stream 88 is produced along with a plurality of other various angled streams 90 from each of the other directional arm(s) 64.

In the preferred embodiment, there is also a flare stream 92 produced from the flare 34. This is preferably produced by the flare stream 92 flowing up through an opening 94 between the nozzle base 32 and the outflow transition 130 (see FIG. 17). When the flare stream 92 exits out of the opening 94 of the outflow transition 130, the flare stream 92 is directed along the outer surface 96 of the flare 34 having a flare angle 98 as measured in relation to the horizontal plane. In this manner, the flare stream 92 is used to create a flare pattern which is a fan of water at a low angle (i.e., the flare angle 98) to the surface of the water surface (e.g., such as a pond or lake, etc.).

Figure 19:
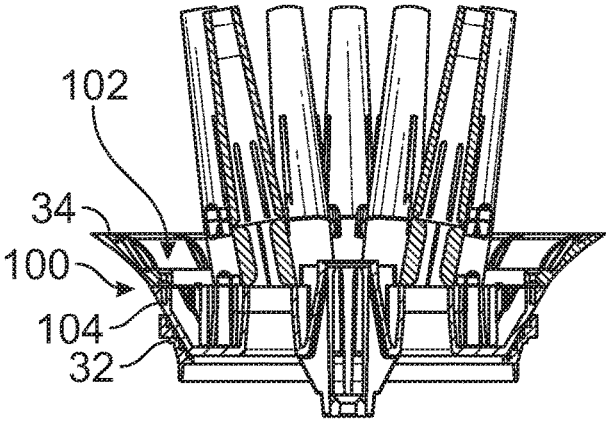
FIG. 19 is a front side cross-sectional view, taken along line 19-19 of FIG. 18, of the flare or flare attachment to the nozzle base.

The flare 34 is releasably attached or connected to the nozzle base 32 using a fastening means 100. Preferably, the fastening means comprises threaded screws or bolts 102 inserted through correspondingly aligned receiving holes 104 to thereby secure the flare 34 to the nozzle base 32, as illustrated in FIG. 19. Alternatively, any other fastening means 100 known to one skilled in the art may be used to releasably secure these parts together.

Figure 20:
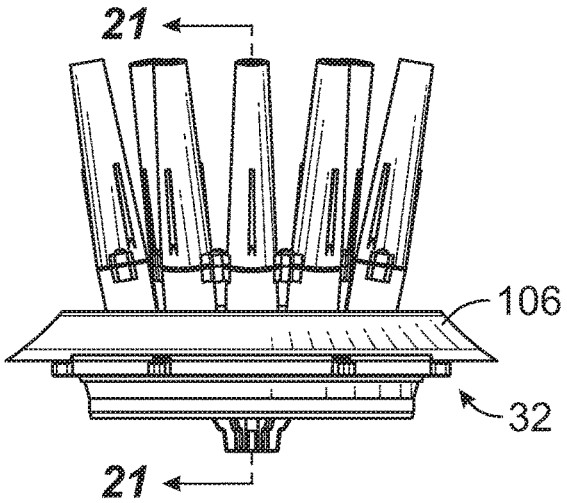
FIG. 20 is a front perspective view of the reversible flare or reversible flare attachment to the nozzle base.
Figure 21:
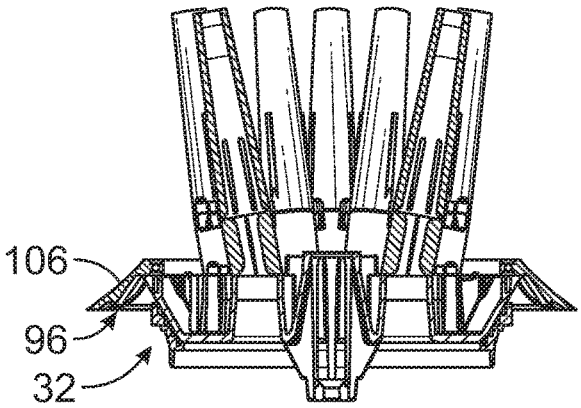
FIG. 21 is a front side cross-sectional view, taken along line 21-21 of FIG. 20, of the reversible flare or reversible flare attachment to the nozzle base.

Additionally, a reversible flare 106 can be attached to the nozzle base 32, as illustrated in FIGS. 20 and 21. In the preferred embodiment, the reversible flare 106 is the exact same as the flare 34 except flipped or upside down. In this manner, the flare stream 92 flowing up through the nozzle base 32 and into and exiting out of the outflow transition 130 (see FIG. 17) will likewise be directed at the outer surface 96 of the reversible flare 106. With the reversible flare 106 being flipped or upside down, the reversible flare 106 is used as a spray shield to deflect unwanted leakage for certain patterns so that the leakage falls straight down back to the water surface (e.g., such as a pond or lake, etc.) and is not seen in the resulting fountain or other visual water displays, spray patterns, and/or designs being produced.

Figure 22:
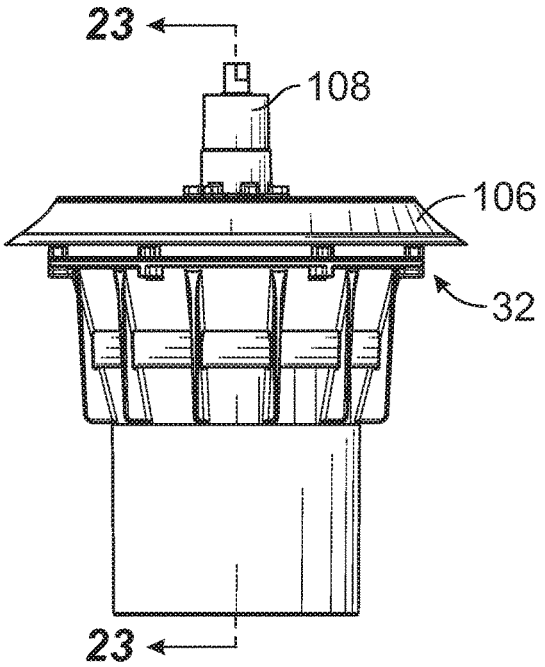
FIG. 22 is a front perspective view of the twister attachment to the nozzle base.
Figure 23:
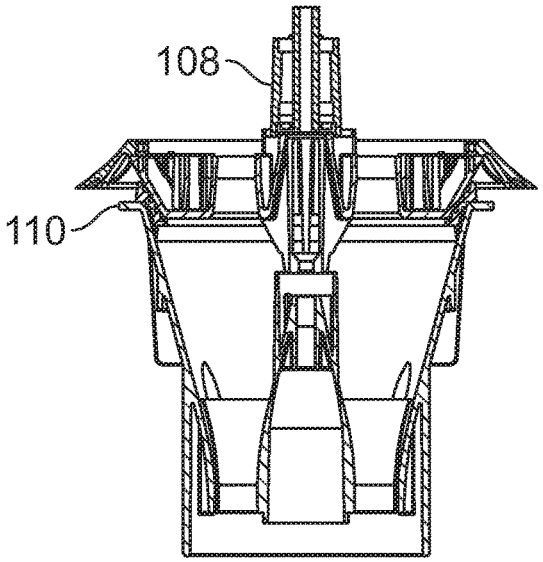
FIG. 23 is a front side cross-sectional view, taken along line 23-23 of FIG. 22, of the twister attachment to the nozzle base.

As illustrated in FIGS. 22 and 23, in lieu of a nozzle 38 being placed directly in the center where the center vertical stream 88 exits (see FIGS. 2 and 17), a twister attachment 108 could be connected to the nozzle base 32 at this location. In the preferred embodiment, the twister attachment 108 allows the nozzle base 32 to self rotate by attaching some or all of the surrounding nozzles 38 at a slight angle, thus producing a tangential force that causes rotation of the nozzle base 32.

In addition, it is also preferable for the twister attachment 108 to be used in conjunction with a labyrinth seal 110, which allows virtually any of the numerous possible patterns to rotate. Rotation is accomplished because the nozzle base 32 is designed to optionally attach a plurality of nozzles 38 at an angle that creates a tangential torque that produces rotation. Further, the rate of spin can be controlled by the number of nozzles 38 attached at this angle. The labyrinth seal 110 is attached to the outlet transition 130. A gap or spacing 140 is created between the nozzle base 32 and the labyrinth seal 142 or the outflow transition 130 for minimal clearance, to minimize the water flowing through the gap or spacing 140 permitting only the desired pattern created by the nozzle base assembly 150 to be visible.

Figure 4:
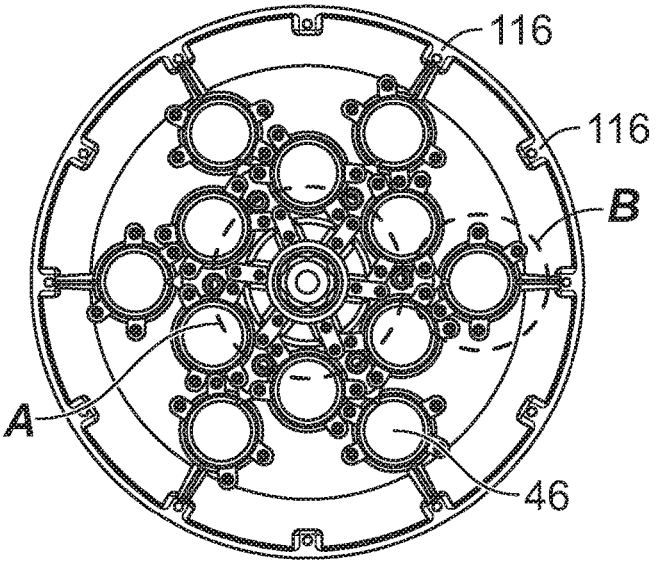
FIG. 4 is a top perspective view of the internal components of the multiple nozzle system device and, in particular, illustrating the channels in the nozzle base and attachment points and holes for mounting the nozzle(s), elbow(s), and twister attachment.

Internally, as illustrated in FIG. 4, which depicts connection points for attaching of the nozzle(s) 38, elbow(s) 36, flare 34, or reversible flare 106 to the nozzle base 32. The flare 34 or reversible flare 106 are releasably attached or connected to the nozzle base 32 using at flare attachment points 116 using the fastening means 100, as described above. Specifically shown in FIG. 4 are various attachment sections, Section A, more clearly illustrated in FIG. 5, and Section B, more clearly illustrated in FIG. 6.

Figure 5:
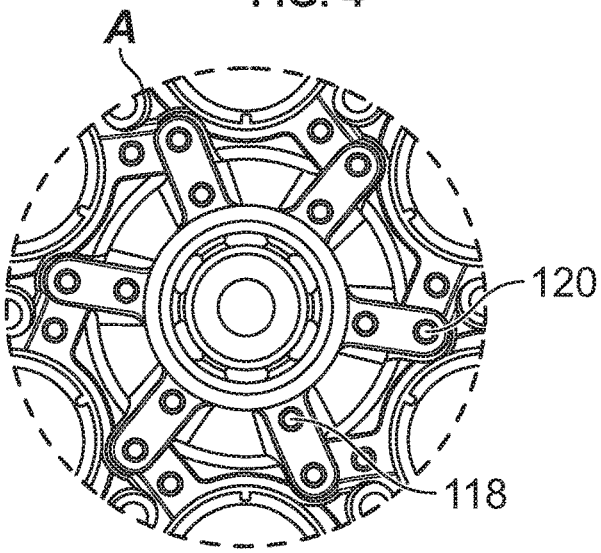
FIG. 5 is a top perspective view of the internal components of Section A of the multiple nozzle system device of FIG. 4.
Figure 7:
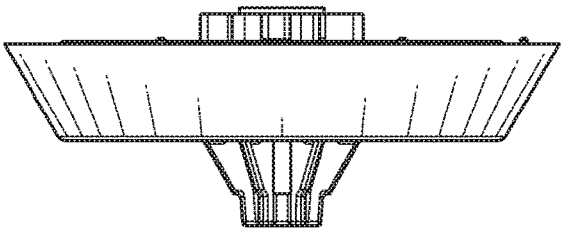
FIG. 7 is a side perspective view of the internal components of the multiple nozzle system device of FIG. 4.

In Section A, as illustrated in FIG. 5, nozzle mounting holes 118 are used to releasably attach the nozzle(s) 38; and twister attachment mounting holes 120 are used to releasably attach the twister attachment 108.

Figure 6:
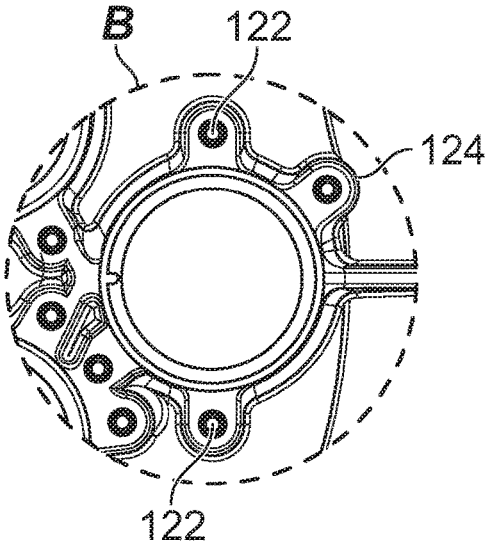
FIG. 6 is a top perspective view of the internal components of Section B of the multiple nozzle system device of FIG. 4.

In Section B, as illustrated in FIG. 6, additional default nozzle/elbow mounting holes 122 or nozzle/elbow mounting holes 124 are used to releasably attach the nozzle(s) 38 or elbow(s) 36.

Figure 24:
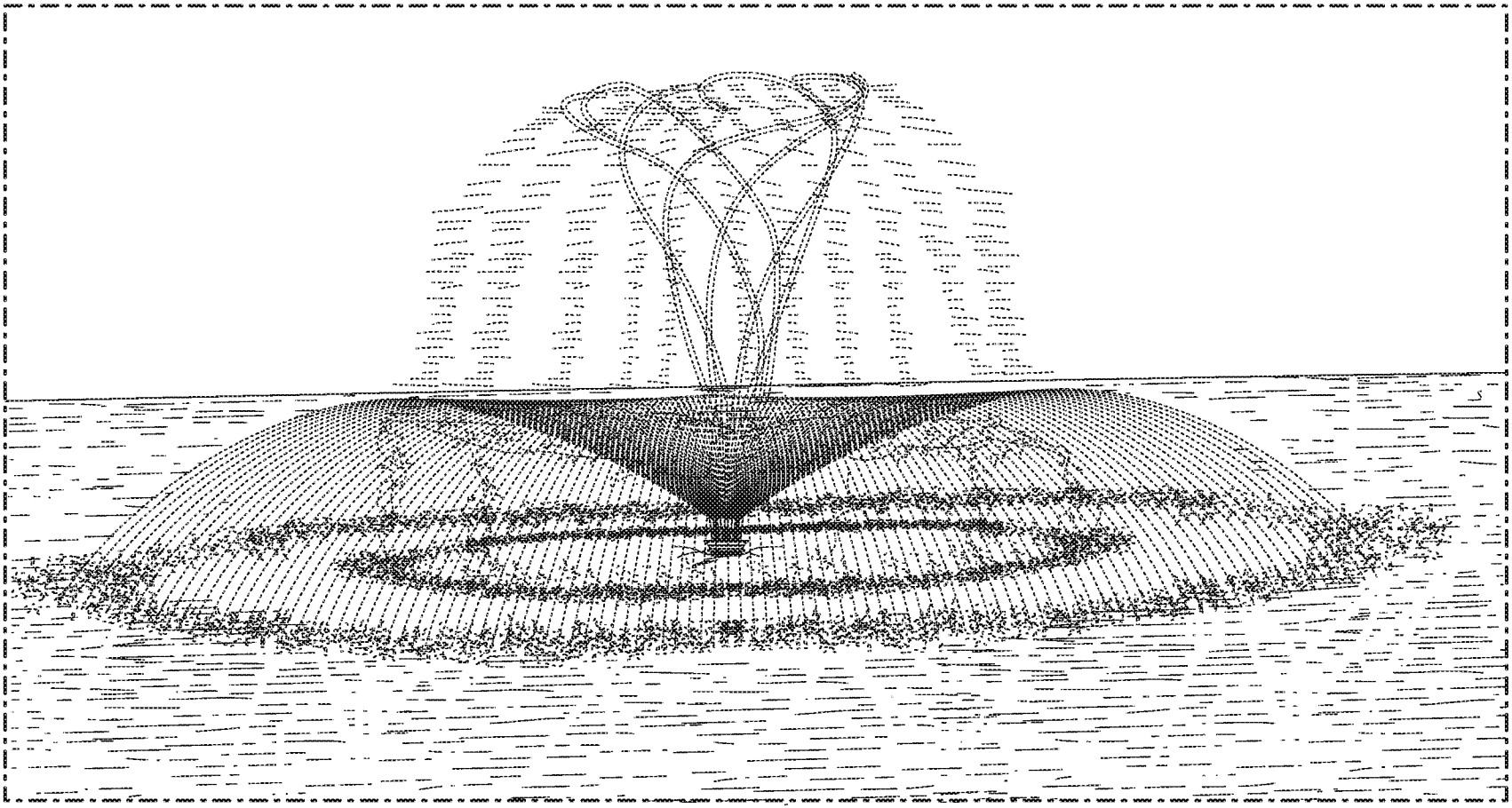
FIG. 24 is a visual water display, fountain, spray pattern, and/or design and, in particular, illustrating a non-limiting example of a rotating or twisting lily design.
Figure 25:
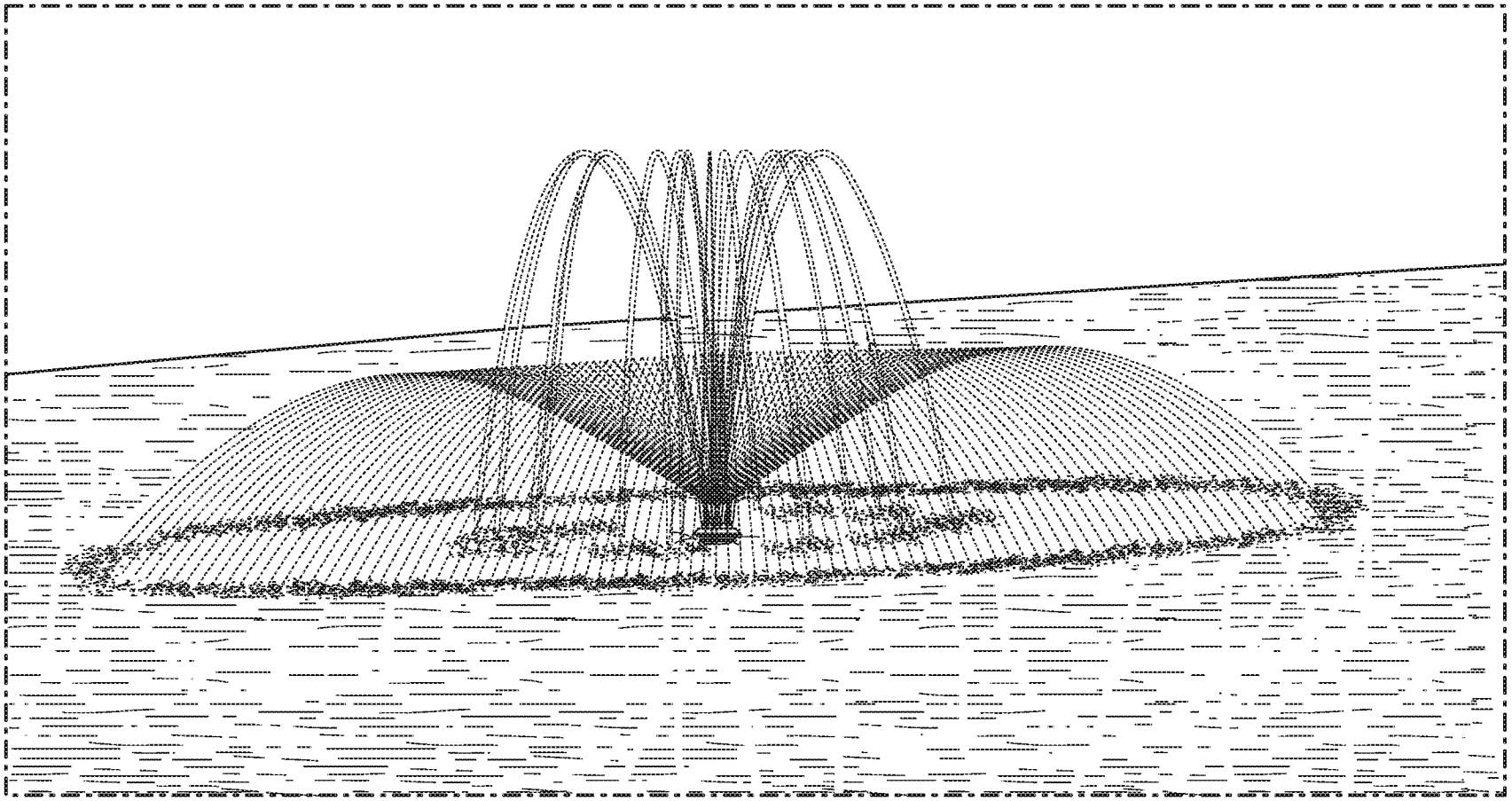
FIG. 25 is a visual water display, fountain, spray pattern, and/or design and, in particular, illustrating a non-limiting example of a super lily design.
Figure 26:
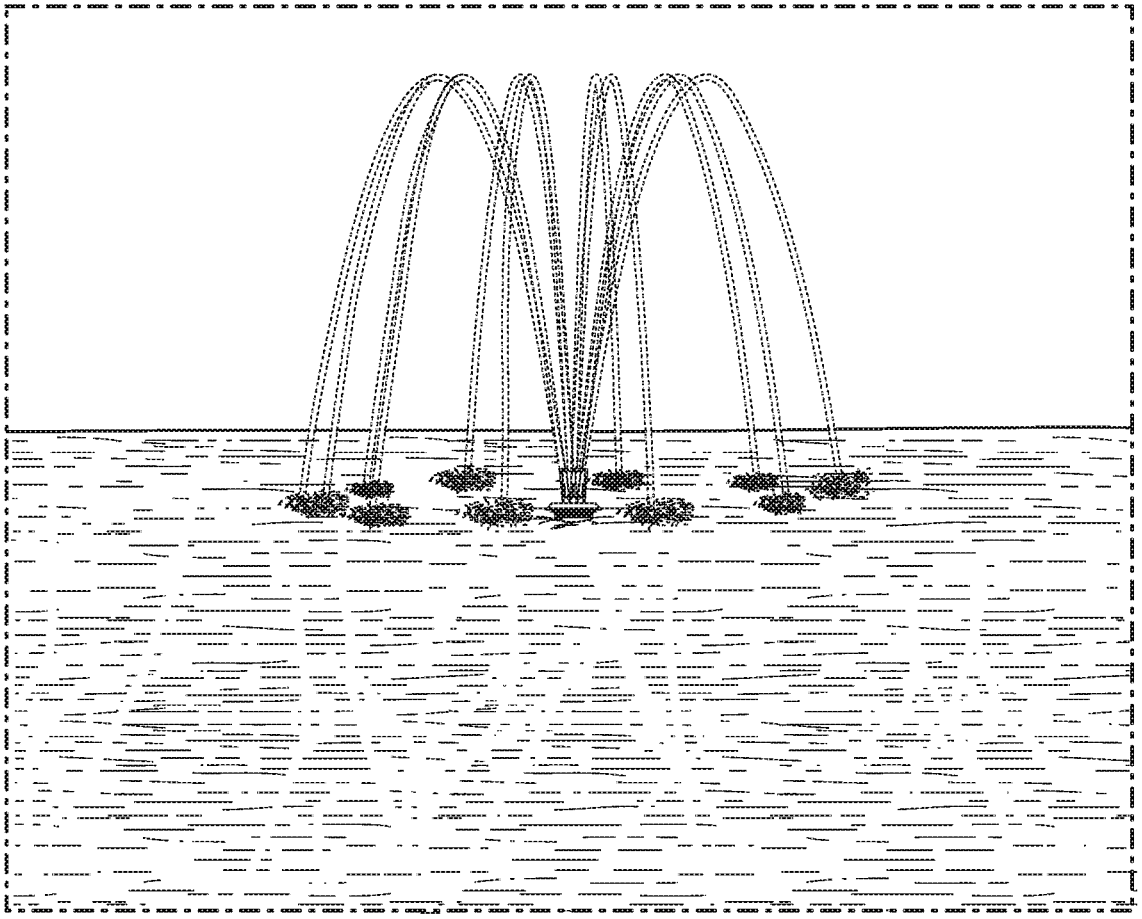
FIG. 26 is a visual water display, fountain, spray pattern, and/or design and, in particular, illustrating a non-limiting example of a cluster arch design.
Figure 27:
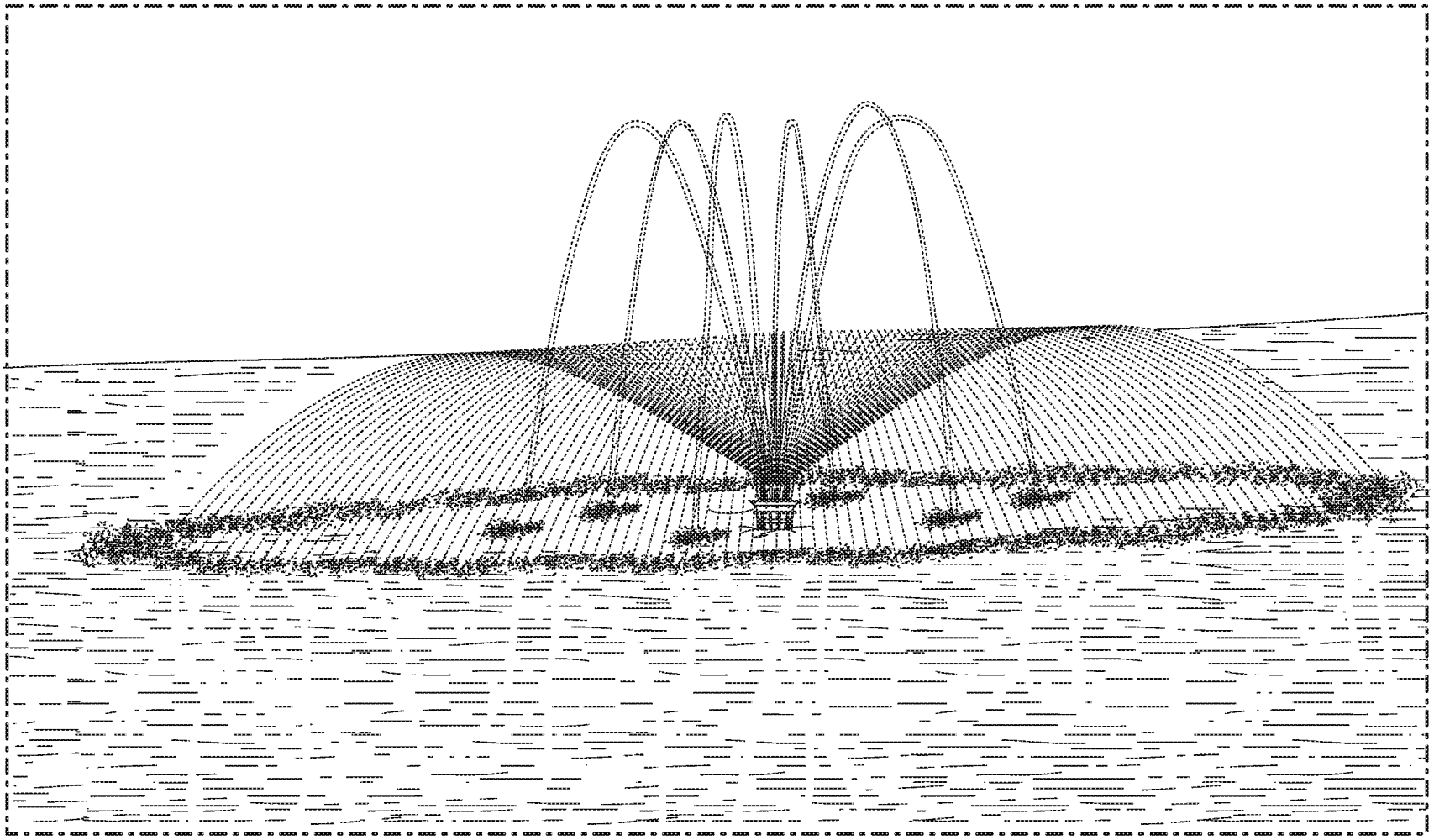
FIG. 27 is a visual water display, fountain, spray pattern, and/or design and, in particular, illustrating a non-limiting example of a lily design.
Figure 28:
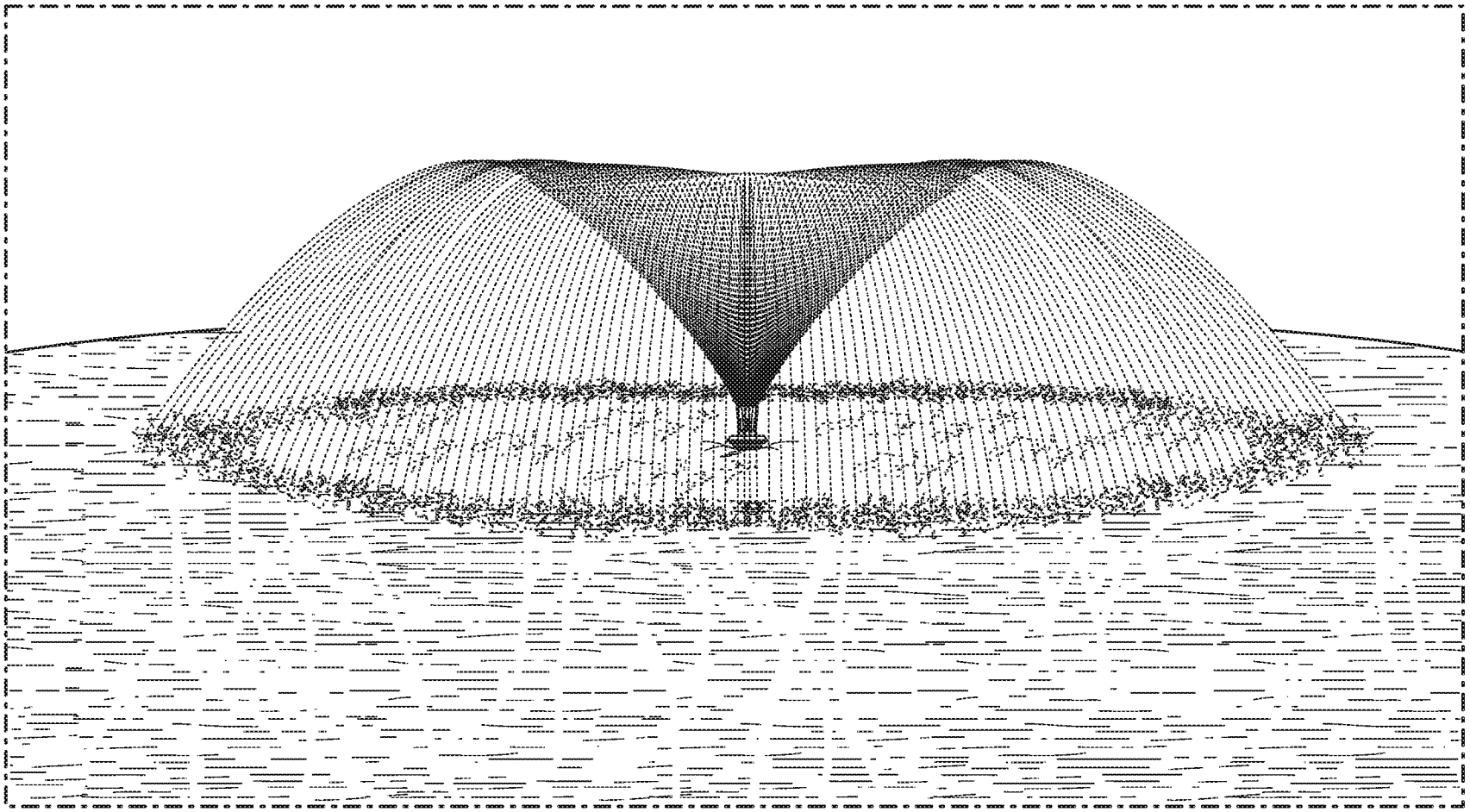
FIG. 28 is a visual water display, fountain, spray pattern, and/or design and, in particular, illustrating a non-limiting example of a high-flow tornado design.
Figure 29:
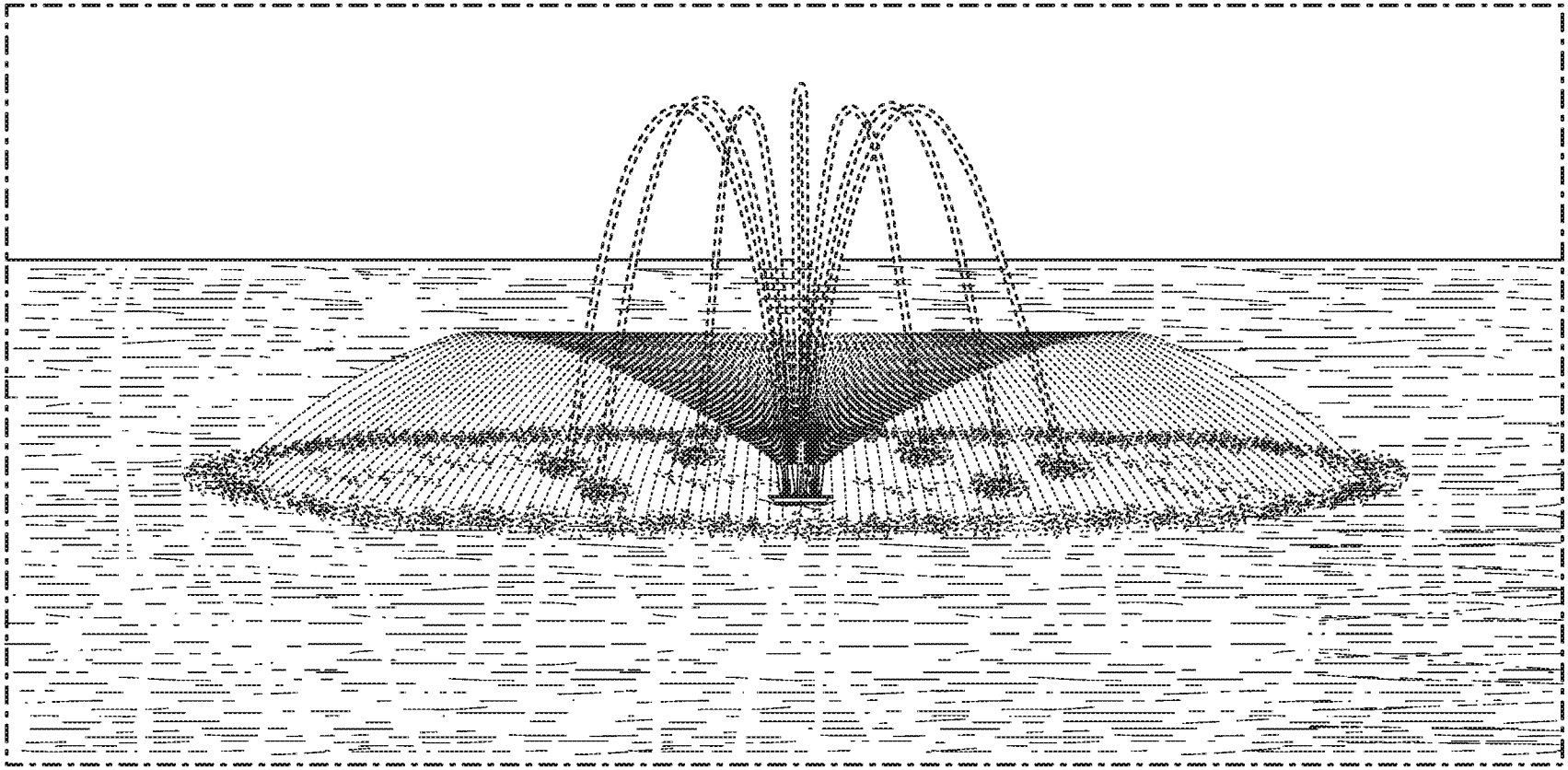
FIG. 29 is a visual water display, fountain, spray pattern, and/or design and, in particular, illustrating a non-limiting example of a fan as part of a lily design.

Depending upon the flow control, the nozzle base 32, whether the flare 34 or reversible flare 106 is used, whether the twister attachment 108 is used, each of the desired directional arm(s) 64 from the combination of the nozzles 38 and elbows 36 used, and the resulting directional angle(s) 84 created for each of the directional arm(s) 64, and possibly the nozzle tips 112 (see FIG. 1) and nozzle length 114 (see FIG. 14), the water (or angled streams 90 (see FIG. 17) exiting from the combination of the various directional arm(s) 64 creates an unlimited number of possible resulting fountains or other visual water displays, spray patterns, or designs (collectively referred to herein as "designs"). Various non-limiting design examples are illustrated in FIG. 24 (rotating or twisting lily design), FIG. 25 (super lily design), FIG. 26 (cluster arch design), FIG. 27 (lily design), FIG. 28 (high-flow tornado design), and FIG. 29 (fan as part of a lily design). Without limitation, for example, any of these designs could also have near vertical or any angled streams that no other multi nozzle system can accomplish.

Based on the description of the device 30 above, Applicant's multiple nozzle system also provides additional benefits and advantages which include without limitation:

(i) Allows for up to at least forty (40) standard nozzle configurations to be designed or built within Applicant's inventive multiple nozzle system using the same or one set of parts, and these parts create thick, high quality, attractive and coherent streams.

(ii) Applicant's inventive multiple nozzle system and component parts can be prebuilt in-house;

(iii) Applicant's component parts can be built or rebuilt by the customer and assembly and dis-assembly of the multiple nozzle system requires only a screwdriver;

(iv) Allows customer the flexibility to change and/or create new patterns, at any time, to whatever pattern they desire or feel like;

(v) And, with Applicant's multiple nozzle system being an additive system (components are added as required to make any specific pattern), the user can create many more possible patterns because Applicant's nozzles, elbows, nozzle tips, and flow controls can be attached in many different ways and are not limited to the initial set of drilled holes; and (vi) Further, in Applicant's system, the flow control component(s) can be releasably attached to any nozzle to efficiently reduce the height of the stream so that multi-tiered patterns can be produced—which is something that the other systems cannot do.

Thus, there has been provided Applicant's unique inventive multiple nozzle system. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A device for use with a fluid comprising:

a nozzle base defining an inlet at one end and an outlet at the other end;

a plurality of channels situated within the nozzle base between the inlet and the outlet, the plurality of channels comprising a first selected set of channels and a second selected set of channels;

a first plurality of nozzles releasably attached to the first selected set of channels and extending outwardly from the outlet of the nozzle base;

the first plurality of nozzles defining a first set of directional arms with each of the directional arms situated at a first plurality of directional angles;

a plurality of elbows releasably attached to the second selected set of channels;

a second plurality of nozzles releasably attached to the plurality of elbows and extending outwardly from the outlet of the nozzle base;

the combination of the plurality of elbows and the second plurality of nozzles defining a second set of directional arms with each of the second set of directional arms situated at a second plurality of directional angles;

at least more than one of the first plurality of directional angles are at different angles than any of the second plurality of directional angles;

at least more than one of the second plurality of directional angles are at different angles;

wherein the flow of fluid through the channels and into and out of the first set of directional arms at the first plurality of directional angles and the second set of directional arms at the second plurality of directional angles creates a visual fluid display.

2. The device of claim 1 wherein each of the plurality of channels comprises a hollow center and defining a channel inlet and a channel outlet at opposed ends.

3. The device of claim 2 wherein each of the first plurality of nozzles comprises a first nozzle hollow center and defining a first nozzle inlet and a first nozzle outlet at opposed ends.

4. The device of claim 3 wherein each of the plurality of elbows comprises an elbow hollow center and defining an elbow inlet and an elbow out at opposed ends.

5. The device of claim 4 wherein each of the second plurality of nozzles comprises a second nozzle hollow center and defining a second nozzle inlet and a second nozzle outlet at opposed ends.

6. The device of claim 5 wherein the first nozzle hollow center in each of the first plurality of nozzles is aligned with a corresponding hollow center in each of the first selected set of channels in the first set of directional arms.

7. The device of claim 6 wherein the elbow hollow center in each of the plurality of elbows is aligned with a corresponding hollow center in each of the second selected set of channels in the second set of directional arms.

8. The device of claim 7 wherein the second nozzle hollow center in each of the second plurality of nozzles is aligned with a corresponding elbow hollow center in each of the plurality of elbows in the second set of directional arms.

9. The device of claim 1 wherein at least more than one of the first plurality of directional angles are at different angles.

10. The device of claim 1 wherein, if any one of the first plurality of directional angles is desired to be changed, an elbow is inserted between one of the first plurality of nozzles and one of the first selected set of channels.

11. The device of claim 1 wherein, if any one of the second plurality of directional angles is desired to be changed, one of the plurality of elbows is replaced with a different elbow.

12. The device of claim 11 wherein, if any one of the second plurality of directional angles is desired to be changed, a first additional elbow is inserted between one of the second plurality of nozzles and one of the second selected set of channels.

13. The device of claim 12 wherein a second additional elbow may be inserted and stacked with the first additional elbow between one of the second plurality of nozzles and one of the second selected set of channels.

14. The device of claim 13 wherein each of the plurality of elbows, the elbow, and the first additional elbow, and the second additional elbow are set at a specific elbow angle.

15. The device of claim 14 wherein at least more than one of the specific elbow angle of the each of the plurality of elbows, the elbow, the first additional elbow, and the second additional elbow are at different angles.

16. A device for use with a fluid comprising:

a nozzle base defining an inlet at one end and an outlet at the other end;

a channel situated within the nozzle base between the inlet and the outlet;

a nozzle releasably attached to the channel and extending outwardly from the outlet of the nozzle base;

the nozzle situated at a first directional angle;

if the first directional angle is to be changed:

(a) a first elbow providing a fixed angle is releasably inserted between the nozzle and the channel, the fixed angle of the first elbow creating a second directional angle for the nozzle;

if the second directional angle is to be changed again:

(b) a different first elbow providing a different fixed angle is releasably inserted between the nozzle and the channel, the different fixed angle of the different first elbow creating a second directional angle for the nozzle; or (c) a second elbow providing a second different fixed angle is releasably inserted between the nozzle and the first elbow, the combination of the fixed angle of the first elbow and the different fixed angle of the second elbow creating a third directional angle for the nozzle;

the first directional angle, the second directional angle, and the third directional angle all being different angles; and wherein the flow of fluid through the channel and into and out of the nozzle at any of the directional angles creates a visual fluid display.

17. The device of claim 16 wherein if the third directional angle is to be changed again a third elbow providing a third different fixed angle is releasably inserted between the nozzle and the second elbow, the third different fixed angle increasing or decreasing the third directional angle to a different fourth directional angle.

* * * * *